US010449414B1

(12) United States Patent
An

(10) Patent No.: US 10,449,414 B1
(45) Date of Patent: Oct. 22, 2019

(54) GOLF SWING ANALYZER

(71) Applicant: Gugsoo An, Changwon-si (KR)

(72) Inventor: Gugsoo An, Changwon-si (KR)

( * ) Notice: Subject to any disclaimer, the term of this patent is extended or adjusted under 35 U.S.C. 154(b) by 0 days.

(21) Appl. No.: 16/257,625

(22) Filed: Jan. 25, 2019

(30) Foreign Application Priority Data

Sep. 7, 2018 (KR) ..... 10-2018-0106843

(51) Int. Cl.
*A63B 69/36* (2006.01)
*A63B 24/00* (2006.01)
*A63B 53/04* (2015.01)

(52) U.S. Cl.
CPC ..... *A63B 24/0003* (2013.01); *A63B 53/04* (2013.01); *A63B 69/3632* (2013.01); *A63B 2053/0445* (2013.01)

(58) Field of Classification Search
CPC . A63B 24/0003; A63B 69/3632; A63B 53/04; A63B 2053/0445; A63B 2209/08; A63B 2220/58; A63B 2225/50; A63B 69/36; A63B 69/3635
USPC ..... 473/220, 221, 222, 223, 224
See application file for complete search history.

(56) References Cited

U.S. PATENT DOCUMENTS

| | | | | |
|---|---|---|---|---|
| 3,953,034 A * | 4/1976 | Nelson | A63B 69/3614 473/220 |
| 5,184,826 A * | 2/1993 | Hall, Jr. | A63B 69/3635 473/224 |
| 5,207,429 A * | 5/1993 | Walmsley | A63B 69/3614 473/220 |
| 5,895,328 A * | 4/1999 | Pahio | A63B 15/005 473/224 |
| 6,450,893 B1 * | 9/2002 | Primiano | A63B 69/3614 473/220 |
| 7,153,216 B1 * | 12/2006 | Pressley | A63B 69/3614 473/220 |
| 7,331,875 B2 * | 2/2008 | Sherman | A63B 69/3635 473/221 |
| 2013/0085008 A1 * | 4/2013 | Hall | A63B 69/3632 473/224 |

FOREIGN PATENT DOCUMENTS

| | | | |
|---|---|---|---|
| KR | 2002-0096076 | A | 12/2002 |
| KR | 10-2005-0092846 | A | 9/2005 |
| KR | 10-0749383 | B1 | 8/2007 |
| KR | 10-0780676 | B1 | 11/2007 |
| KR | 10-2011-0017231 | A | 2/2011 |
| KR | 10-2012-0018097 | A | 2/2012 |
| KR | 10-1263256 | B1 | 5/2013 |
| KR | 10-1415945 | B1 | 7/2014 |
| KR | 10-1762793 | B1 | 7/2017 |

* cited by examiner

*Primary Examiner* — Nini F Legesse
(74) *Attorney, Agent, or Firm* — Hauptman Ham, LLP

(57) ABSTRACT

Disclosed is a golf swing analyzer capable of easily checking a swing trace and a swing speed of a golf club and an impact point.

5 Claims, 12 Drawing Sheets

GOLF SWING ANALYZER

CROSS REFERENCE TO RELATED APPLICATION

This application claims priority from Korean Patent Application No. 10-2018-0106843, filed on Sep. 7, 2018, which is hereby incorporated by reference for all purposes.

BACKGROUND OF THE INVENTION

Field of the Invention

The present invention relates to a golf swing analyzer, and more particularly, to a golf swing analyzer capable of easily checking a swing trace and a swing speed of a golf club and an impact point.

Background of the Related Art

Golf is a club-and-ball sport in which players use various clubs to hit balls into a series of holes on a course in as few strokes as possible.

A golf club is a club used to hit a golf ball in a game of golf, and includes a head which strikes the golf ball, a grip held by hands, and a shaft to connect the head and grip.

A motion of hitting the golf ball stood on the ground by the golf club is referred to as swing, and a trace and speed of the swing and an impact point which is a point hitting the golf ball have a big effect on a flying direction and distance of the golf ball.

In general, the motion of the golf swing can be explained by a number of steps of address, back-swing, upswing, downswing, impact, follow-through, and finish, of which each motion is connected to each other.

A good golfer should always maintain an accurate swing trace and an accurate impact point, but a process of training the swing skill is hard. Also, it is hard to continuously maintain a good swing posture. In particular, a process of figuring out and changing a wrong posture at swing is necessary. To this end, it is necessary to accurately analyze own swing.

Various technologies capable of analyzing the golf swing are disclosed in Korean Patent Nos. 10-1415945, 10-0780676, 10-0749383, and 10-1263256, and Korean Unexamined Patent Publication Nos. 10-2012-0018097, 10-2011-0017231, 10-2005-0092846, and 10-2002-0096076.

Because the conventional apparatuses for analyzing the golf swing utilize a golf club which is specifically manufactured, or their golf clubs used at the game, it is not enough to easily and accurately analyze the swing trace and the impact point.

In order to compensate the above drawbacks, the applicant developed an golf swing analyzer which is detachably installed to the golf club to easily and accurately analyze the swing trace of the golf club and the impact point by radiation of light, which is disclosed in Korean Patent No. 10-1762793. The present invention improves the above patent.

SUMMARY OF THE INVENTION

Therefore, the present invention has been made in view of the above problems, and one object of the present invention is to provide a golf swing analyzer which is detachably installed to a golf club to easily check and analyze a swing trace and a swing speed of the golf club and an impact point by radiation of light.

According to one aspect of the present invention, there is provided a golf swing analyzer including: a body including a horizontal portion and a vertical portion to form a T-shape, the horizontal portion and the vertical portion having an inner empty space; a mounting member which is integrally installed to the vertical portion of the body, and is detachably connected to a shaft of a golf club; a plurality of light emitting elements which are installed in pairs to both sides of the horizontal portion of the body to emit light to an outside; a light emitting substrate which is mounted to the inner empty space of the horizontal portion of the body, and is provided with a control circuit to supply a power to the light emitting elements and to control an operation thereof; a weight which is movably installed in the inner empty space of the vertical portion of the body in a longitudinal direction of the vertical portion; a resilient member which is installed in the inner empty space of the vertical portion of the body to apply a force to the weight toward the horizontal portion; a reed switch which is installed in the inner empty space of the vertical portion to be turned on or off by detecting a moved position of the weight; an acceleration sensing substrate which is provided with the reed switch, and a circuit to send a signal of the reed switch to the light emitting substrate; a reference light emitting element which is disposed inside a lower portion of the vertical portion to emit the light toward the outside, thereby accurately determining a position and a direction when the mounting member is connected to the shaft of the golf club; a reference light emitting substrate which is provided with a control circuit to supply the power to the reference light emitting element and to control operation of the reference light emitting element; and an operation button which is installed to one side of the lower portion of the horizontal portion in a button mode, in which when the operation button is pushed down, the operation button sends an electric signal to the reference light emitting substrate to operate the reference light emitting element.

A head of the golf club is provided with a plurality of grooves extending in a straight line, and a bottom surface of the vertical portion is provided with a window plate extending in one direction, through which the light emitted from the reference light emitting element passes in a straight line, so that the light is aligned with the groove formed on the head of the golf club.

With the above configuration, when a user swings the golf club, the weight is moved by a centrifugal force, and thus the reed switch is turned on, so that the light emitting elements disposed at both sides of the horizontal portion emit the light. Therefore, since the trace of the emitted light forms the swing trace, the user can easily check and analyze the swing trace to correct a golf swing posture or effectively correct an impact position.

The light emitted from the reference light emitting element operated by the operation button is aligned with the groove formed on the head of the golf club through the window plate, thereby mounting the mounting member at the wanted position of the shaft to improve the use convenience.

Since the movement of the weight caused by the centrifugal force can be adjusted by the resilient control member, the user can practice individual golf skill by adjusting the light emitting time of the light emitting element according to own force and speed per user. Also, the distance between the resilient member and the weight can be accurately adjusted through the identification portion.

DETAILED DESCRIPTION OF THE PREFERRED EMBODIMENT

Figure 1:
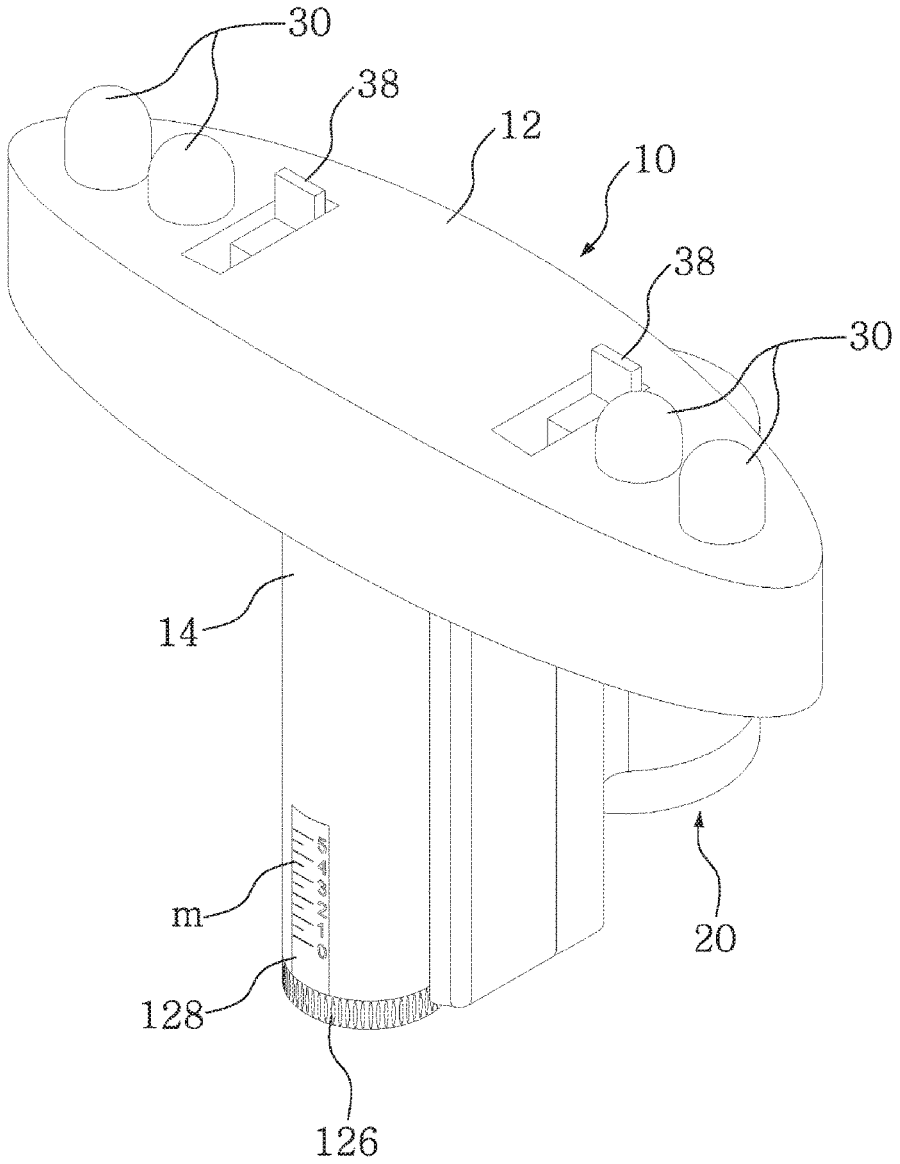
FIGS. 1 to 8 are views illustrating a preferable mode of the present invention.

A preferred embodiment of the present invention will be hereafter described in detail with reference to the accompanying drawings.

FIGS. 1 to 8 are views illustrating a preferable mode of the present invention. As illustrated in FIGS. 1 to 7, a golf swing analyzer according to one embodiment of the present invention includes a body 10, a mounting member 20, a plurality of light emitting elements 30, a light emitting substrate 40, a weight 50, a reed switch 60, an acceleration detecting substrate 70, a resilient member 80, a reference light emitting element 90, a reference light emitting substrate 100, and an operation button 110.

The body 10 includes a horizontal portion 12 and a vertical portion 14 to form a T-shape. The horizontal portion 12 and the vertical portion 14 have an inner empty space to provide an installation space for components of the present invention.

The mounting member 20 is integrally installed to the vertical portion 14 of the body 10.

The mounting member 20 is configured to protrude from the vertical portion 14 of the body 10.

The mounting member 20 is detachably connected to a shaft 4 of a golf club.

The mounting member 20 is formed to have a C-shaped cylindrical cross section, of which a portion of a circumference is cut to form an engaging groove 24.

If the mounting member 20 is formed as described above, the C-shaped cross section is widened to receive a shaft 4 of the golf club, and after the shaft is inserted into the C-shaped cross section, the mounting member 20 resiliently encloses at least half circumference of the shaft 4 of the golf club not to be easily released from the shaft.

The mounting member 20 may be made of a high frictional material (e.g., rubber, silicon or soft synthetic resin) so that the mounting member is not moved up and down in the state of being engaged to the shaft 4 of the golf club.

The engaging groove 24 is provided with a plurality of ridges to press the circumference of the shaft 4.

Also, the mounting member 20 has a latch hook 26 formed on one side of the engaging groove 24, and a latch bar 27 formed on the other side of the engaging groove 24 which is received in the latch hook 26 to press the engaging groove 24.

Specifically, the shaft 4 can be stably fixed by the ridges 25 and the latch bar 27 locked to the latch hook, thereby improving a fixing force between the shaft 4 and the mounting member 20.

The light emitting element 30 is installed to both sides of the horizontal portion 12, and is configured to be turned on by operation of the weight 50, the reed switch 60 and the acceleration detecting substrate 70 which are operated by swing speed of the golf club, which will be described later.

Also, when the mounting member 20 is engaged to the shaft 4, the light emitting element 30 installed to the horizontal portion 12 faces a grip of the golf club.

Specifically, a pair of light emitting element 30 is disposed to both sides of the horizontal portion 12 of the body 10.

The light emitting elements 30 are installed to the horizontal portion 12 of the body 10 in a state of which a portion is exposed to emit the light outwardly.

The light emitting substrate 40 is mounted to the inner empty space of the horizontal portion 12 of the body 10.

The light emitting substrate 40 is provided with a control circuit to supply a power to the light emitting elements 30 and to control the operation thereof.

For example, the light emitting substrate 40 is provided with a battery to operate the light emitting elements 30 with its own power.

The horizontal portion 12 may be further provided with a luminance control switch 38 which is connected to the control circuit of the light emitting substrate 40 to control the brightness of the light emitting elements 30.

The luminance control switch 38 may include a rotary switch.

One light emitting element 30 may be respectively installed to both sides of the horizontal portion, and two or more light emitting elements 30 may be respectively installed to both sides thereof.

Figure 2:
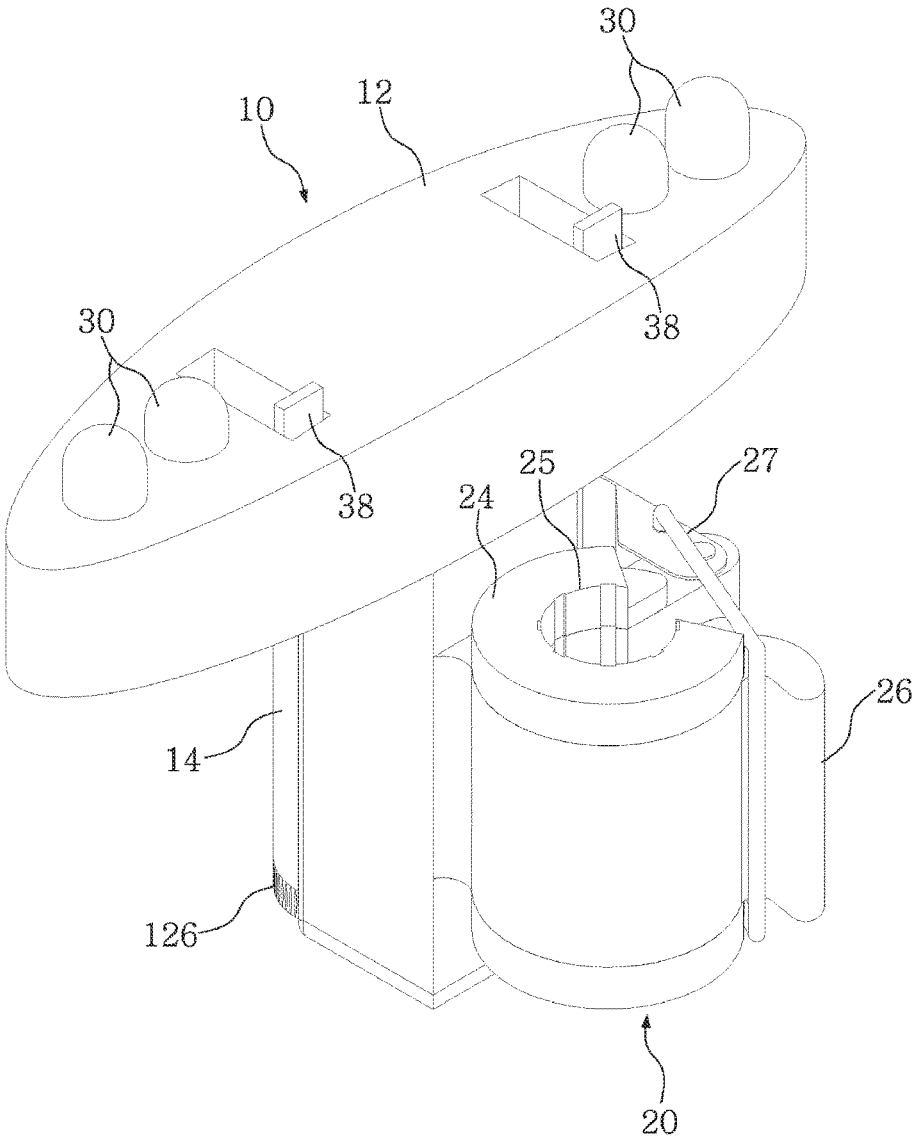
Figure 3:
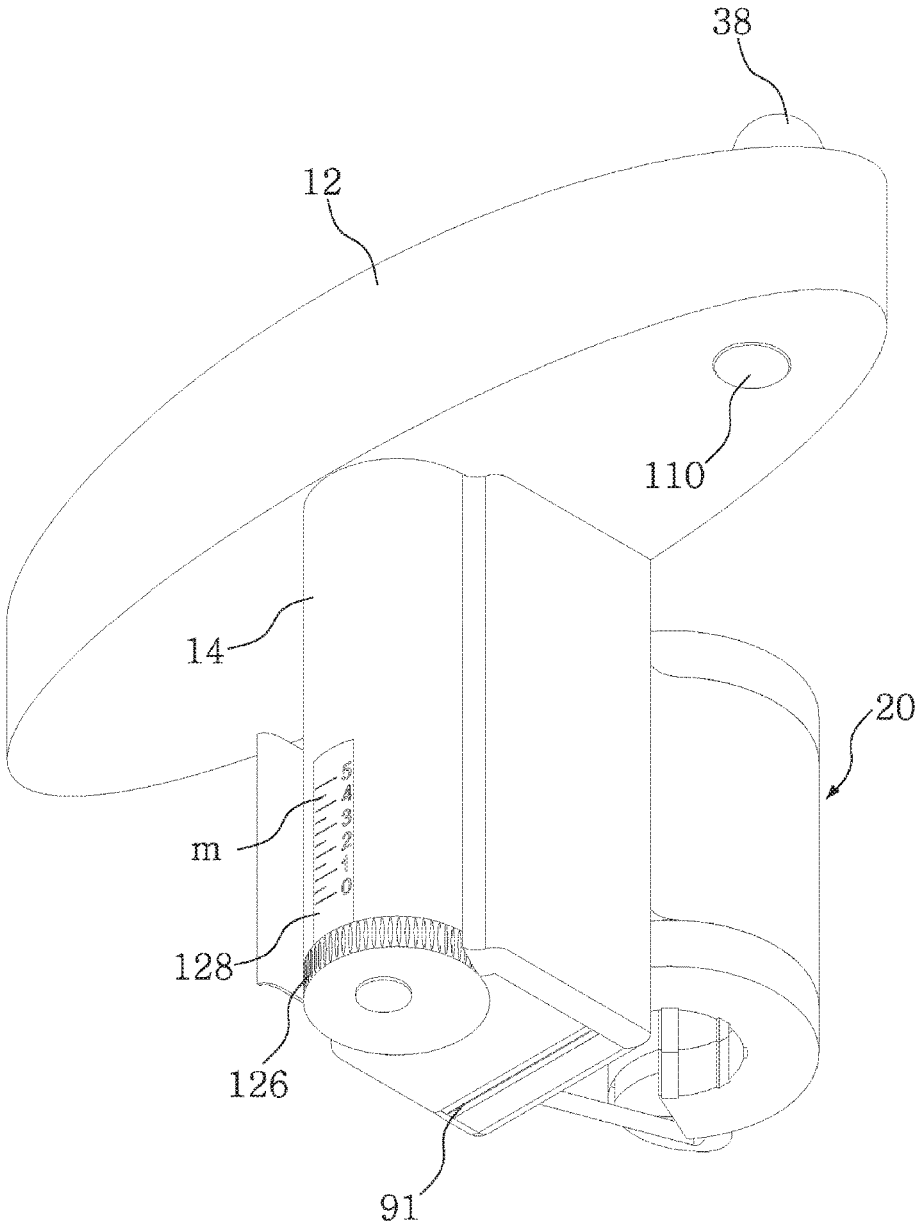
Figure 4:
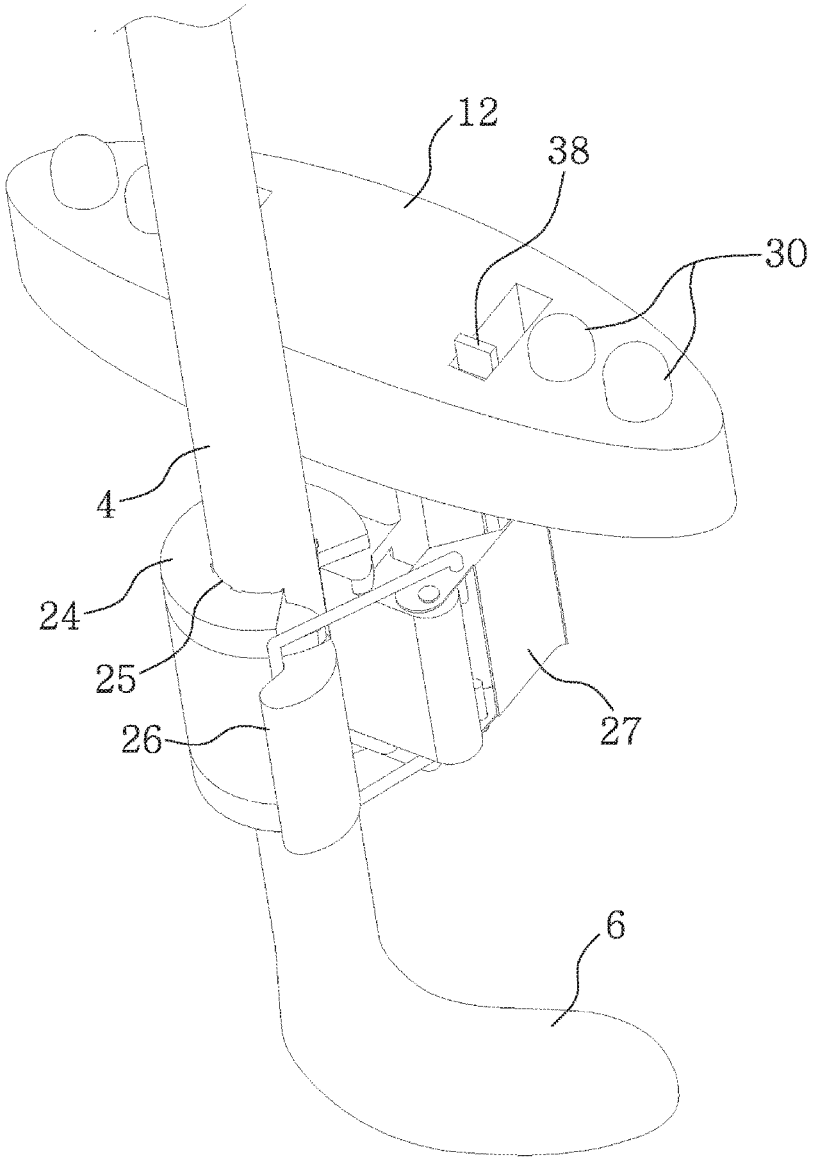
Figure 5:
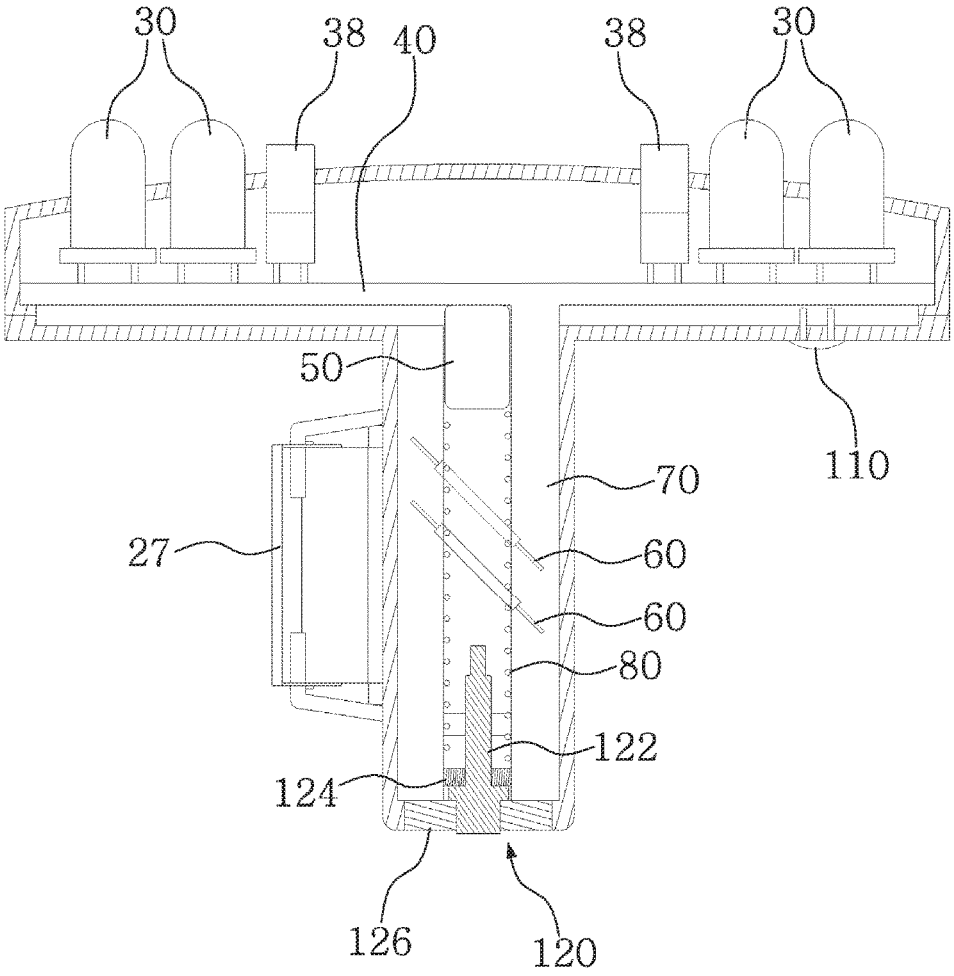
Figure 6:
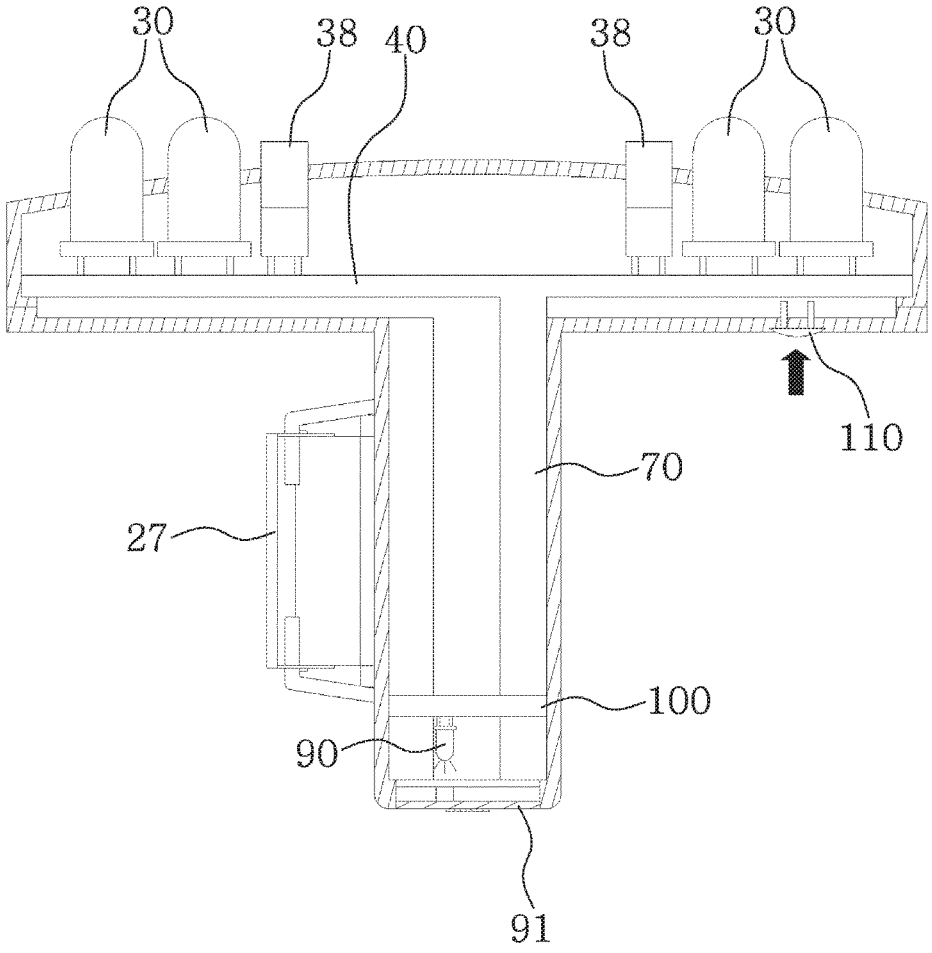
Figure 7:
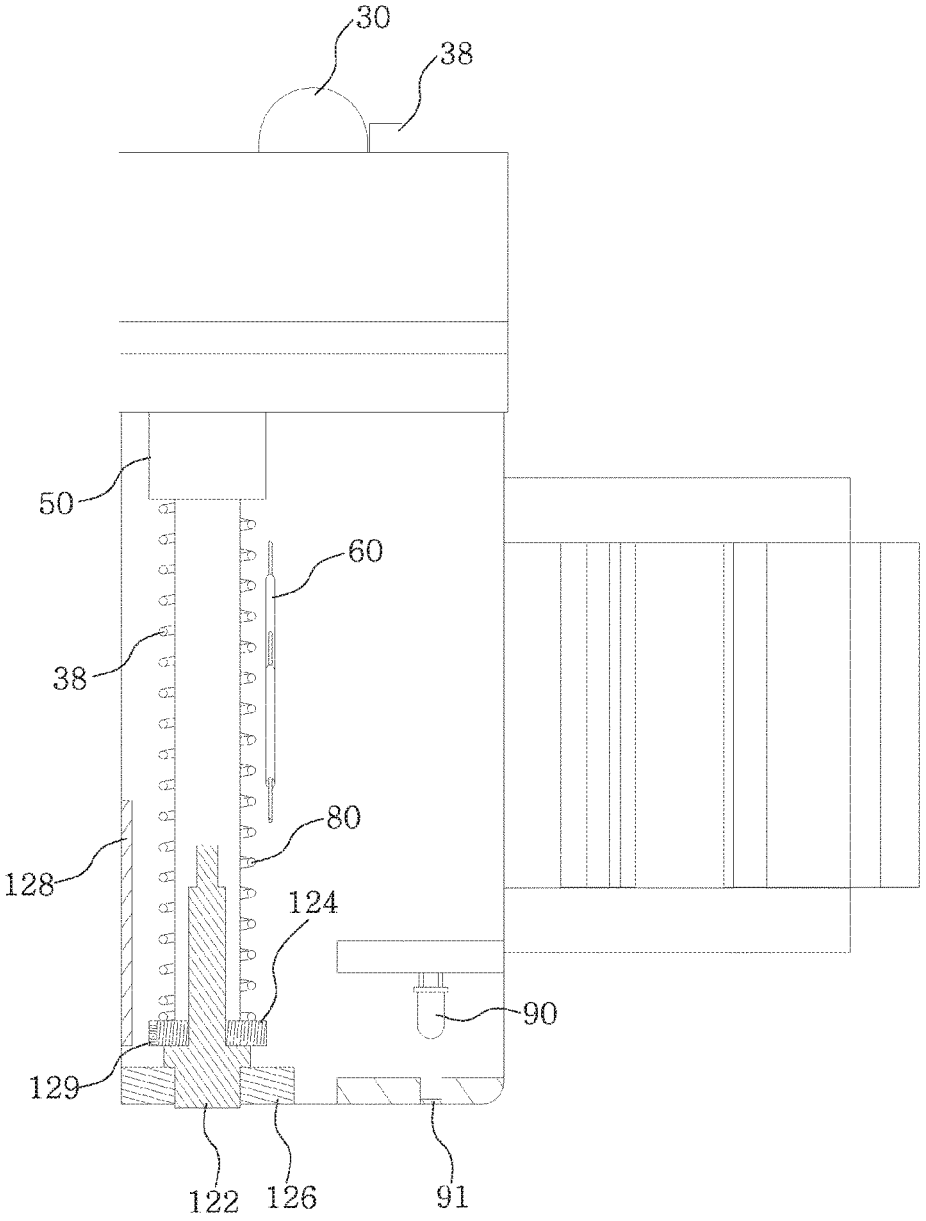
Figure 8:
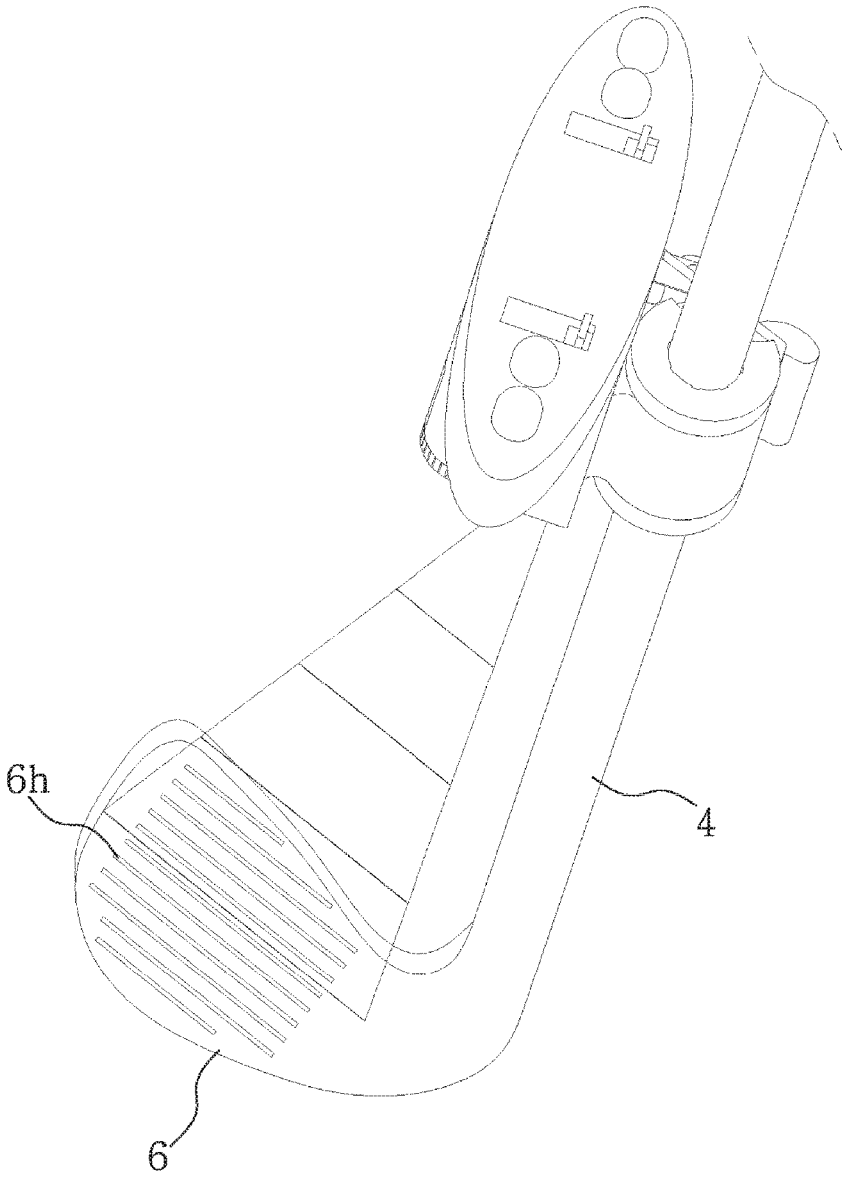

For example, as illustrated in FIGS. 1 and 2, two light emitting elements 30 may be respectively installed to both sides thereof.

In case where two or more light emitting elements 30 are respectively installed to both sides thereof, the control circuits of the light emitting substrate 40 may be configured in such a way that the outer light emitting elements are in pairs, the intermediate light emitting elements are in pairs, and the inner light emitting elements are in pairs, respectively, to be operated simultaneously.

Also, the outer and inner light emitting elements may be in pairs to be operated simultaneously.

The light emitting elements 30 disposed at the outer position and the inner position may be configured to emit the light of different colors.

The weight 50 is movably installed in the inner empty space of the vertical portion 14 of the body 10 in the longitudinal direction of the vertical portion 14.

The weight 50 is pressed toward the horizontal portion 12 by the resilient member 80 which is installed in the inner empty space of the vertical portion 14 of the body 10.

The resilient member 80 includes a compression spring.

The reed switch 60 is installed in the inner empty space of the vertical portion 14 of the body 10 to be turned on or off by a moved position of the weight 50.

For example, if the weight 50 is made of a magnet, and the reed switch 60 is configured to detect a magnetic force, as the weight 50 comes close to the reed switch 60, the reed switch detects the motion, and then is turned on.

If the weight 50 is made of an electric conductor, and the reed switch 60 is configured to be applied by a current according to approach of the electric conductor, as the weight 50 comes close to the reed switch 60, the reed switch may detect the motion, and then may be turned on.

If the reed switch 60 includes a limit switch or a proximity sensor, as the weight 50 comes close to the reed switch 60, the reed switch may detect the motion, and then is turned on.

The reed switch 60 is mounted onto the acceleration sensing substrate 70 which is configured to send a signal of the reed switch 60 to the light emitting substrate 40.

In case where two or more pairs of the light emitting elements are installed and the circuit is configured to operate the light emitting elements in pairs, the reed switch 60 may be installed according to the number of pairs of the light emitting elements 30.

For example, the control circuit of the light emitting substrate 40 and the circuit of the acceleration sensing substrate 70 may be configured in such a way that the reed switches 60 are installed in plural at regular intervals from the side adjacent to the horizontal portion 12, and the signal of the reed switch 60 closest adjacent to the horizontal portion 12 operates the pair of furthermost light emitting elements 30.

With the above configuration, as the weight 50 moves away from the horizontal portion 12, the light emitting elements 30 are sequentially turned on from the outside to the inside.

Since the movement of the weight 50 is caused by a centrifugal force generated by rotation of the golf club, the movement of the weight 50 away from the horizontal portion 12 means that the golf club is accelerated. Therefore, it is possible to analyze the swing speed by checking that any pair of the light emitting elements 30 is operated.

The reference light emitting element 90 is disposed inside the lower portion of the vertical portion 14 to emit the light toward the outside, thereby accurately determining the position and direction when the mounting member 20 is connected to the shaft 4 of the golf club.

The reference light emitting substrate 100 is provided with a control circuit to supply the power to the reference light emitting element 90 and to control operation of the reference light emitting element.

The operation button 110 is installed to one side of the lower portion of the horizontal portion 12 in a button mode, and, when the operation button is pushed down, the operation button sends an electric signal to the reference light emitting substrate 100 to operate the reference light emitting element 90.

Although not illustrated in the drawing, the operation button 110 and the reference light emitting substrate 100 are electrically connected to each other through a cable or a separate substrate.

Specifically, as the operation button 110 is pushed down, the reference light emitting substrate 100 supplies the power to the reference light emitting element 90 to operate the reference light emitting element 90, so that the position and direction of the mounting member 20 to be connected to the shaft of the golf club can be accurately determined by the light emitted from the reference light emitting element 90.

Accordingly, when the user swings the golf club, the weight 50 is moved by the centrifugal force, and thus the reed switch 60 is turned on, so that the light emitting elements 40 disposed at both sides of the horizontal portion 12 emit the light. Therefore, since the trace of the emitted light forms the swing trace, the user can easily check and analyze the swing trace to correct a golf swing posture or effectively correct an impact position.

A head 6 of the golf club is provided with a plurality of grooves **6*h*** extending in a straight line.

A bottom surface of the vertical portion 14 is provided with a window plate 91, through which the light emitted from the reference light emitting element 90 passes in a straight line, so that the user can align the groove **6*h* formed on the head 6** of the golf club with the light.

Specifically, the light emitted from the reference light emitting element 90 operated by the operation button 110 is aligned with the groove **6*h* formed on the head 6 of the golf club through the window plate 91**, thereby mounting the mounting member at the wanted position of the shaft to improve the use convenience.

The vertical portion 14 is further provided with a resilient control member 120 to adjust a resilient force applied to the weight 50 by the resilient member 80.

The resilient control member 120 has an adjust screw 122 with a male threaded portion which is fastened to the lower portion of the vertical portion.

Also, the resilient control member 120 has a movable member 124 which is provided with a female threaded portion which is fastened with the threaded portion formed on the adjust screw 122, so that the resilient control member is moved up and down according to a rotating direction of the adjust screw 122 to shorten or extend the distance between the resilient member 80 and the weight 50, thereby controlling the resilient force applied to the weight 50.

Also, the resilient control member 120 has an adjust knob 126 to receive a lower portion of the adjust screw 122, the adjust knob being exposed outwardly from the vertical portion 14 to rotate the adjust screw 122 in a forward or reverse direction.

The adjust knob 126 is integrally installed to the exposed end of the adjust screw 122, and the adjust screw 126 is rotated in place by rotation of the adjust knob 126. As described above, the movable member 124 is fastened with the adjust screw 122, and thus is moved up and down along the threaded portion by rotation of the adjust screw 122.

The adjust screw 122 is provided with a locking protrusion to prevent the adjust screw from being released from the vertical portion 14, and is rotated in place in the vertical portion 14 by and the adjust knob 126 and the locking protrusion.

The resilient control member 120 has a window portion 128 made of a transparent material in a direction of the vertical direction 14 in which the movable member 124 is moved, and the window portion 128 is provided with a gradation m on a surface thereof to see the position of the movable member.

Also, the resilient control member 120 has an identification portion 129 attached to one side of the movable member 124 to display a separate color.

The identification portion 129 can be provided by a conventional sticker or by painting.

Accordingly, since the movable member 124 is moved up and down by the rotation of the adjust knob 126 to shorten or extend the distance between the resilient member 80 and the weight 50, the resilient control member 120 can control the resilient force applied to the weight 50 depending upon the swing speed or a body type of the user. Also, the distance between the resilient member 80 and the weight 50 can be more accurately adjusted through the identification portion 129.

The method of using the golf swing analyzer according to the embodiment of the present invention will now be described with reference to the configuration described above.

First of all, the mounting member 20 is connected to the shaft 4 of the golf club. In this instance, the groove 6*h* formed on the head 6 of the golf club is aligned with the light emitted from the reference light emitting element 90.

Figure 9:
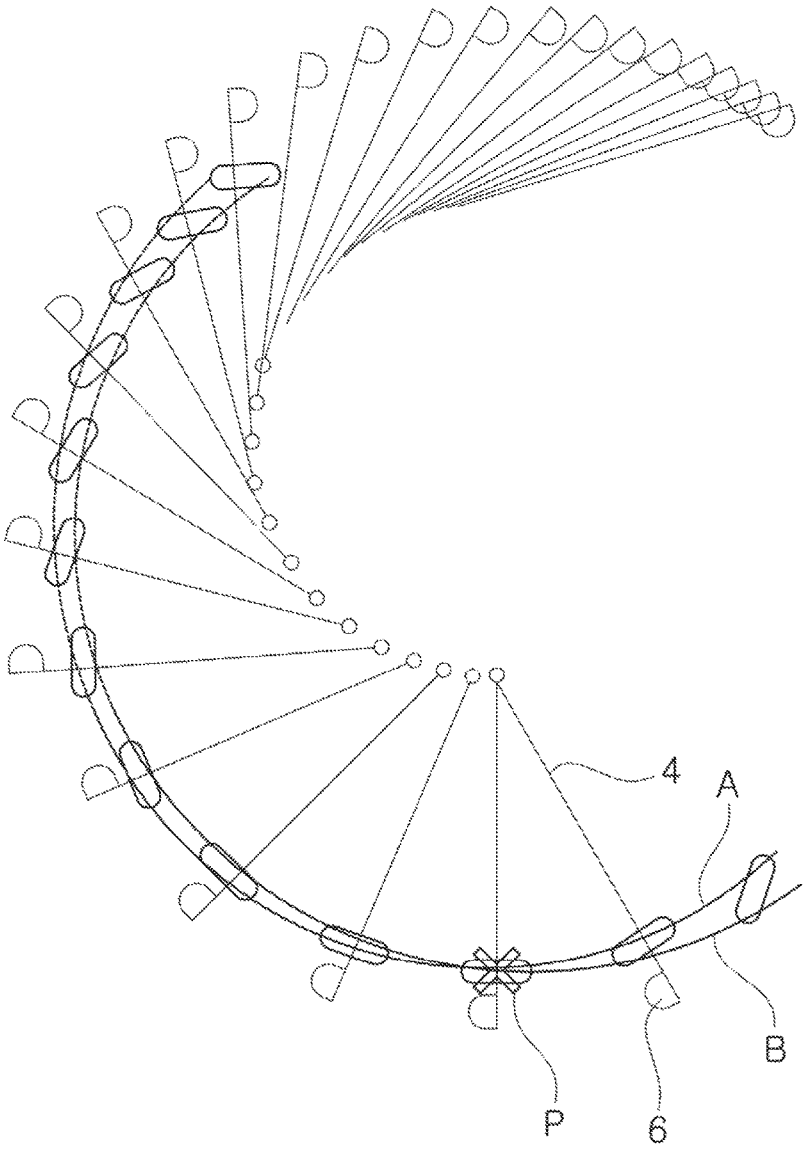
FIG. 9 is a view illustrating a swing path as a series of photos when a user is swinging a golf club mounted with a golf swing analyzer according to one embodiment of the present invention.

If the user swings the golf club in the above mounting state, the swing trace is shown, as illustrated in FIG. 9.

In FIG. 9, a curve indicated by B shows the trace of the light emitted from the light emitting element 30 positioned at the right side in FIG. 1, while a curve indicated by A shows the trace of the light emitted from the light emitting element 30 positioned at the left side in FIG. 1.

In the traces indicated by A and B, a dotted line shows the state in which only one light emitting element 30 disposed at the left and right sides in FIG. 1 is turned on, while a solid line shows the state in which two light emitting elements 30 disposed at the left and right sides in FIG. 1 are turned on.

Specifically, as the user progressively swings the golf club, the weight 50 is moved by the centrifugal force, so that one reed switch 60 is first turned on. As the swing speed is accelerated, two reed switches 60 are turned on.

It is possible to analyze an acceleration point by checking that how many light emitting elements 30 are turned on, as well as checking the swing speed.

In case where the color of the light emitting elements 30 are different from each other, it is possible to analyze the acceleration point by checking that any color of the light emitting element 30 is turned on.

In the case where the color of the light emitting elements 30 are different from each other, the control circuit of the light emitting substrate 40 can be configured to operate any one color of the light emitting elements 30 according to the movement of the weight 50. In this instance, it is convenient to analyze a point where the color of the light emitted from the light emitting element is changed, as the acceleration point.

Since the swing trance can be checked by the trace of the light emitted from the light emitting elements 30, the analysis of the swing trace can be easily performed.

The trace of the light emitted from the light emitting elements 30 can be taken by continuous exposure of a camera, or can be imaged as a moving picture.

In case where the user accurately swings the golf club, the head of the golf club is positioned in a state perpendicular to the swing direction at a location where the golf ball is placed.

Figure 10:
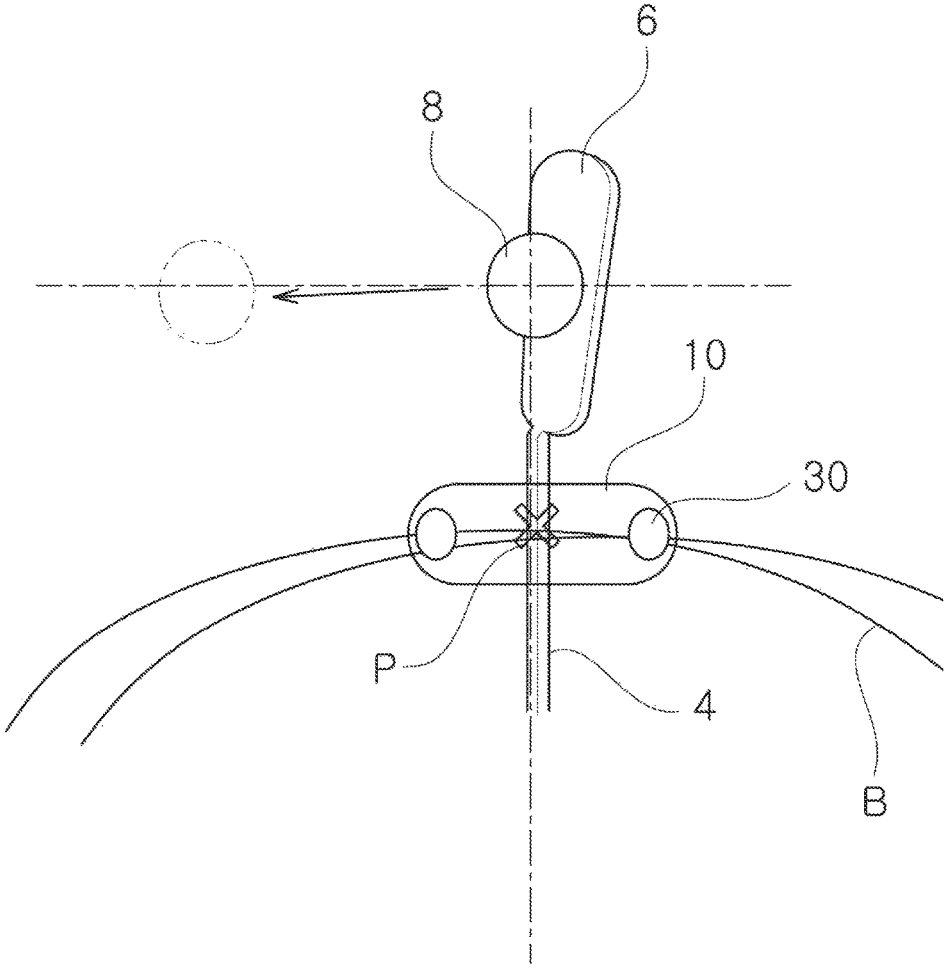
FIG. 10 is a view illustrating an impact instant of a golf ball at a normal impact position when the user is swinging the golf club mounted with the golf swing analyzer according to one embodiment of the present invention.

For example, as illustrated in FIGS. 9 and 10, the trace A and the trace B intersect with each other at the location of the golf ball (impact position) to form an X-shape.

In FIGS. 9 to 12, the location indicated by X shows the impact position P at which the golf ball should be impacted when the user normally swings the golf club.

Figure 11:
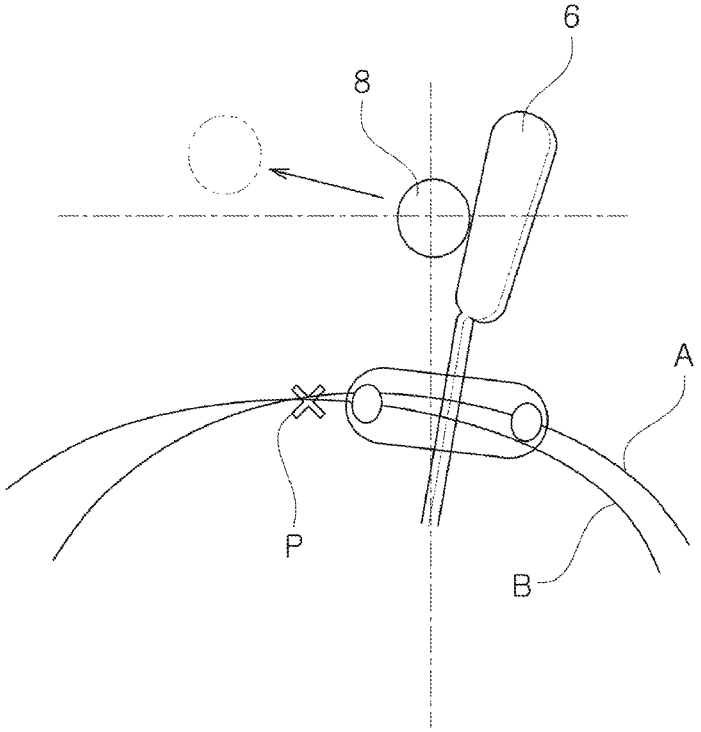
FIG. 11 is a view illustrating an impact instant of the golf ball before the normal impact position when the user is swinging the golf club mounted with the golf swing analyzer according to one embodiment of the present invention.

A slice happens when a club head is traveling directly down the impact position P or slightly inside-to-outside at impact, while the club face is pointed right of a path, as illustrated in FIG. 11.

Figure 12:
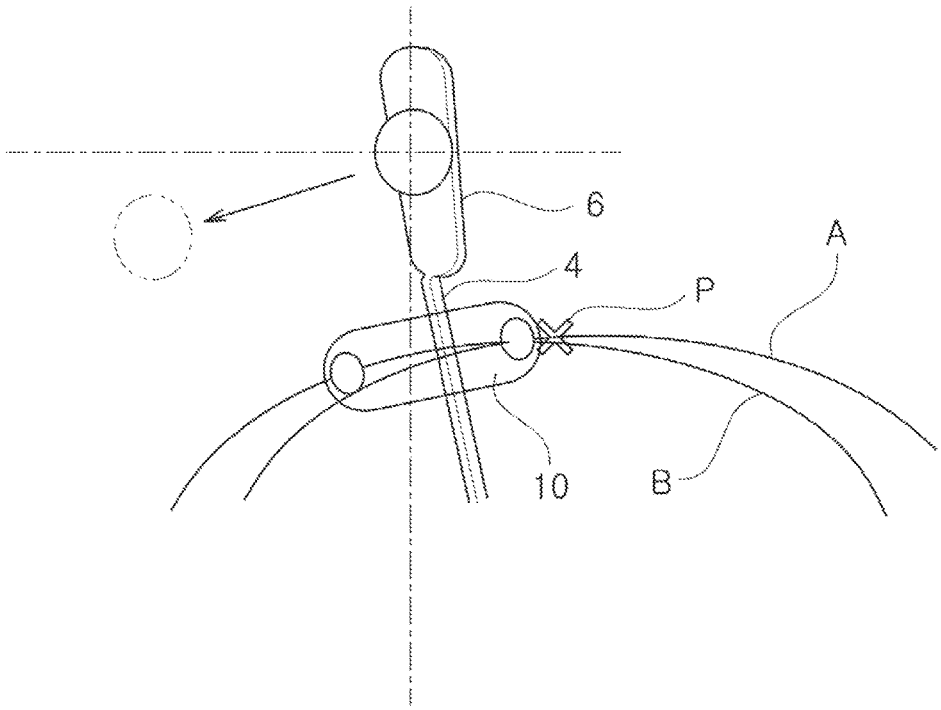
FIG. 12 is a view illustrating an impact instant of the golf ball after the normal impact position when the user is swinging the golf club mounted with the golf swing analyzer according to one embodiment of the present invention.

A hook occurs when a golfer hangs back on his right side and starts the downswing by throwing his hands at the ball by flipping the hands and turning the club face too quickly producing a whipping action at the ball and the club makes contact with the ball in a closed position, as illustrated in FIG. 12.

If the swing is completed, the weight 50 is moved toward the horizontal portion 12 by the resilient force of the resilient member 80, and the reed switch 60 is turned off to turn the light emitting elements 30 off.

Whenever the user swings the golf club, the light emitting elements 30 are turned on, but when the user does not swing, the light emitting elements 30 are turned off, thereby minimizing consumption of the battery. Therefore, it is not necessary to install a power interrupting device.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A golf swing analyzer comprising:

a body (10) including a horizontal portion (12) and a vertical portion (12) to form a T-shape, the horizontal portion and the vertical portion having an inner empty space;

a mounting member (20) which is integrally installed to the vertical portion (14) of the body (10), and is detachably connected to a shaft (4) of a golf club;

a plurality of light emitting elements (30) which are installed in pairs to both sides of the horizontal portion (12) of the body (10) to emit light to an outside;

a light emitting substrate (40) which is mounted to the inner empty space of the horizontal portion (12) of the body (10), and is provided with a control circuit to supply a power to the light emitting elements (30) and to control an operation thereof;

a weight (50) which is movably installed in the inner empty space of the vertical portion (14) of the body (10) in a longitudinal direction of the vertical portion (14);

a resilient member (80) which is installed in the inner empty space of the vertical portion (14) of the body (10) to apply a force to the weight (50) toward the horizontal portion (12);

a reed switch (60) which is installed in the inner empty space of the vertical portion (14) to be turned on or off by detecting a moved position of the weight (50);

an acceleration sensing substrate (70) which is provided with the reed switch (60), and a circuit to send a signal of the reed switch (60) to the light emitting substrate (40);

a reference light emitting element (90) which is disposed inside a lower portion of the vertical portion (14) to emit the light toward the outside, thereby accurately determining a position and a direction when the mounting member (20) is connected to the shaft (4) of the golf club;

a reference light emitting substrate (100) which is provided with a control circuit to supply the power to the reference light emitting element (90) and to control operation of the reference light emitting element; and an operation button (110) which is installed to one side of the lower portion of the horizontal portion (12) in a button mode, in which when the operation button is pushed down, the operation button sends an electric signal to the reference light emitting substrate (100) to operate the reference light emitting element (90).

2. The golf swing analyzer according to claim 1, wherein a head (6) of the golf club is provided with a plurality of grooves (6*h*) extending in a straight line, and a bottom surface of the vertical portion (14) is provided with a window plate (91) extending in one direction, through which the light emitted from the reference light emitting element (90) passes in a straight line, so that the light is aligned with the groove (6*h*) formed on the head (6) of the golf club.

3. The golf swing analyzer according to claim 1, wherein the mounting member (20) includes an engaging groove (24) which is formed to have a C-shaped cylindrical cross section, and has a plurality of protrusions (25), a latch hook (26) formed on one side of the engaging groove (24), and a latch bar (27) formed on the other side of the engaging groove (24) which is received in the latch hook (26) to press the engaging groove (24).

4. The golf swing analyzer according to claim 1, wherein the vertical portion (14) is further provided with a resilient control member (120) to adjust a resilient force applied to the weight (50) by the resilient member (80), and the resilient control member (120) has an adjust screw (122) with a male threaded portion which is fastened to the lower portion of the vertical portion, a movable member (124) which is provided with a female threaded portion which is fastened with the threaded portion formed on the adjust screw (122), so that the resilient control member is moved up and down according to a rotating direction of the adjust screw (122) to shorten or extend a distance between the resilient member (80) and the weight (50), thereby controlling the resilient force applied to the weight (50), an adjust knob (126) configured to receive a lower portion of the adjust screw (122), the adjust knob being exposed outwardly from the vertical portion (14) to rotate the adjust screw (122) in a forward or reverse direction, a window portion (128) which is made of a transparent material in a direction of the vertical direction (14) in which the movable member (124) is moved, the window portion (128) being provided with a gradation (m) on a surface thereof to see the position of the movable member, and an identification portion (129) attached to one side of the movable member (124) to display a separate color.

5. The golf swing analyzer according to claim 1, wherein the horizontal portion (12) is further provided with a luminance control switch (38) which is connected to the control circuit of the light emitting substrate (40) to control brightness of the light emitting elements (30).

* * * * *